US008750554B2

(12) United States Patent
Sakamoto

(10) Patent No.: US 8,750,554 B2
(45) Date of Patent: Jun. 10, 2014

(54) SPEAKER DIAPHRAGM AND SPEAKER DEVICE

(75) Inventor: Takao Sakamoto, Saitama (JP)

(73) Assignee: Sony Corporation (JP)

( * ) Notice: Subject to any disclaimer, the term of this patent is extended or adjusted under 35 U.S.C. 154(b) by 109 days.

(21) Appl. No.: 13/502,651

(22) PCT Filed: Oct. 15, 2010

(86) PCT No.: PCT/JP2010/068654

§ 371 (c)(1),
(2), (4) Date: Jun. 25, 2012

(87) PCT Pub. No.: WO2011/049189

PCT Pub. Date: Apr. 28, 2011

(65) Prior Publication Data

US 2012/0263337 A1 Oct. 18, 2012

(30) Foreign Application Priority Data

Oct. 22, 2009 (JP) ..... P2009-243766

(51) Int. Cl.
*H04R 7/14* (2006.01)

(52) U.S. Cl.
CPC ..... *H04R 7/14* (2013.01)
USPC ..... 381/423; 381/429; 181/173; 181/174

(58) Field of Classification Search
CPC ..... H04R 7/14; H04R 7/12; H04R 7/02
USPC ..... 381/370, 374, 398, 423, 396, 400, 386, 381/184, 389, 395, 408, 425, 429; 455/569.1, 575.2; 24/3.1; 181/173, 181/157, 167, 174
See application file for complete search history.

(56) References Cited

U.S. PATENT DOCUMENTS

| | | | | | |
|---|---|---|---|---|---|
| 1,080,953 | A | * | 12/1913 | Catucci | 181/164 |
| 1,990,409 | A | * | 2/1935 | Athol | 181/164 |
| 2,531,634 | A | * | 11/1950 | Lawrence | 181/164 |
| 3,093,207 | A | * | 6/1963 | Bozak | 181/166 |
| 4,581,496 | A | * | 4/1986 | Sweany | 381/429 |

(Continued)

FOREIGN PATENT DOCUMENTS

| | | |
|---|---|---|
| JP | 01143497 | 6/1989 |
| JP | 07203583 | 8/1995 |

(Continued)

OTHER PUBLICATIONS

International Search Report for PCT/JP2010/068654 dated Dec. 7, 2010.

*Primary Examiner* — Curtis Kuntz
*Assistant Examiner* — Joshua A Kaufman
(74) *Attorney, Agent, or Firm* — Lerner, David, Littenberg, Krumholz & Mentlik, LLP

(57) ABSTRACT

A speaker diaphragm (2), and plural dimples (16) which are disposed radially from a center side toward the outside of the speaker diaphragm (2) and which have arch structures formed to have a concave-like shapes so as to disperse a stress are provided, whereby while weight saving is realized in terms of the speaker diaphragm (2) by the plural dimples (16) formed to have the concave-like shapes, high rigidity is maintained by the arch structures of the dimples concerned, and a maximum sound pressure can be increased along with the weight saving concerned.

7 Claims, 13 Drawing Sheets

(56) References Cited

U.S. PATENT DOCUMENTS

| | | | | |
|---|---|---|---|---|
| 5,539,835 | A * | 7/1996 | Bertagni et al. | 381/423 |
| 6,731,773 | B1 * | 5/2004 | Bergbower et al. | 381/397 |
| 6,863,153 | B1 * | 3/2005 | Hayakawa et al. | 181/173 |
| 7,704,428 | B2 | 4/2010 | Takayama et al. | |
| 2005/0078850 | A1 * | 4/2005 | Norton | 381/423 |
| 2006/0239494 | A1 * | 10/2006 | Kimura et al. | 381/386 |
| 2007/0092101 | A1 * | 4/2007 | McKenzie | 381/398 |

FOREIGN PATENT DOCUMENTS

| | | | |
|---|---|---|---|
| JP | 2000184492 | A | 6/2000 |
| JP | 2003052099 | A | 2/2003 |
| JP | 2005252424 | A | 9/2005 |
| JP | 2005-318012 | A | 11/2005 |
| JP | 2007043522 | A | 2/2007 |
| JP | 2008271025 | A | 11/2008 |

* cited by examiner

SPEAKER DIAPHRAGM AND SPEAKER DEVICE

CROSS-REFERENCE TO RELATED APPLICATION

The present application is a national phase entry under 35 U.S.C. §371 of International Application No. PCT/JP2010/068654 filed Oct. 15, 2010, published on Apr. 28, 2011 as WO 2011/049189 A1, which claims priority from Japanese Patent Application No. JP 2009-243766 filed in the Japanese Patent Office on Oct. 22, 2009.

TECHNICAL FIELD

The present invention relates to a speaker diaphragm and a speaker device, and more particularly is suitable for being applied to a subwoofer.

BACKGROUND ART

Heretofore, it has been required for a material of a diaphragm used in a subwoofer or the like that the material concerned has a small density and a high Young's modulus (rigidity), a moderate internal loss, and an environment resistance performance. Since a diaphragm made of polypropylene as an olefin system resin is excellent in an environment resistance, especially, durability, and is fine in an external appearance property, and is moderately large in an internal loss, and is also fine in a physicality balance in terms of a diaphragm for a speaker, the diaphragm made of polypropylene is frequently used next to a paper.

However, since in the diaphragm made of polypropylene, a specific gravity of polypropylene is 0.9 [g/cm$^3$] which is larger than that of the paper, and has also a low Young's modulus, the rigidity is increased by reinforcement using a filler such as a carbon fiber. In this case, however, the specific gravity becomes larger. For this reason, the diaphragm made of polypropylene becomes heavier than the paper. Thus, in the diaphragm made of polypropylene, a sensitivity is reduced and an energy in a high-frequency band is also hard to output.

On the other hand, a diaphragm having a multi-layer structure is proposed which includes a first diaphragm and a second diaphragm which are made of materials, respectively, different from each other (for example, Patent Document 1).

PRIOR ART DOCUMENT

Patent Document

Patent Document 1: Japanese Patent Laid-Open No. 2005-318012

SUMMARY OF THE INVENTION

Now, liquid crystal polymer or the like is used as a material for the diaphragm from a viewpoint of increasing the rigidity in some cases. However, there is caused a problem that the specific gravity becomes large and thus the internal loss also becomes smaller than that of polypropylene.

In addition, a diaphragm adopting a honeycomb structure or a diaphragm having a three-layer structure in which a foam is sandwiched between flat plate-like skin layers is known as a diaphragm desiring weight saving and increased rigidity in terms of a structure. In particular, however, the diaphragm having the three-layer structure involves a problem that since it is necessary to bond the layers to one another, the number of complicated manufacturing processes is increased to cause cost increasing.

In addition, since the diaphragm having the multi-layer structure described in Patent Document 1 described above is formed by carrying out injection molding, the complicated manufacturing process that the first diaphragm layer and the second diaphragm layer are bonded to each other is unnecessary. However, there is caused a problem that the weight of the diaphragm itself is increased due to the multi-layer structure.

The present invention has been made in consideration of the points described above, and it is therefore an object of the present invention to propose a speaker diaphragm which has a large internal loss, and which is capable of further promoting weight saving to increase a maximum sound pressure without reducing high rigidity and an environment resistance, and a speaker device.

In order to solve such problems, a speaker diaphragm of the present invention includes a diaphragm, and plural dimples which are radially disposed from a center side of the diaphragm toward an outer periphery side of the diaphragm, and which have arch structures each formed so as to have a concave-like shape in such a way that a stress is dispersed.

As a result, while the weight saving is realized in terms of the diaphragm by the plural dimples each formed so as to have the concave-like shape, the high rigidity is maintained by the arch structures of the dimples and it is possible to increase the maximum sound pressure along with the weight saving concerned.

In addition, a speaker device of the present invention includes a diaphragm, plural dimples which are radially disposed from a center side of the diaphragm toward an outer periphery side of the diaphragm, and which have arch structures each formed so as to have concave-like shape in such a way that a stress is dispersed, and a magnetic circuit portion for vibrating the diaphragm in accordance with an audio signal.

As a result, while the weight saving is realized in terms of the diaphragm by the plural dimples each formed so as to have the concave-like shape, the high rigidity is maintained by the arch structures of the dimples and it is possible to increase the maximum sound pressure when the diaphragm is vibrated by the magnetic circuit portion along with the weight saving concerned.

According to the present invention, it is possible to realize the speaker diaphragm in which while the weight saving is realized in terms of the diaphragm by the plural dimples each formed so as to have the concave-like shape, the high rigidity is maintained by the arch structures of the dimples and it is possible to increase the maximum sound pressure along with the weight saving concerned.

In addition, according to the present invention, it is possible to realize the speaker device in which while the weight saving is realized in terms of the speaker diaphragm by the plural dimples each formed so as to have the concave-like shape, the high rigidity is maintained by the arch structures of the dimples and it is possible to increase the maximum sound pressure when the diaphragm is vibrated by the magnetic circuit portion along with the weight saving concerned.

MODES FOR CARRYING OUT THE INVENTION

Hereinafter, modes for carrying out the invention will be described. It is noted that the description will be given below in accordance with the following order.

1. Embodiment
2. Other Embodiments

<1. Embodiment>

[1-1. Construction of Speaker Device]

Figure 1:
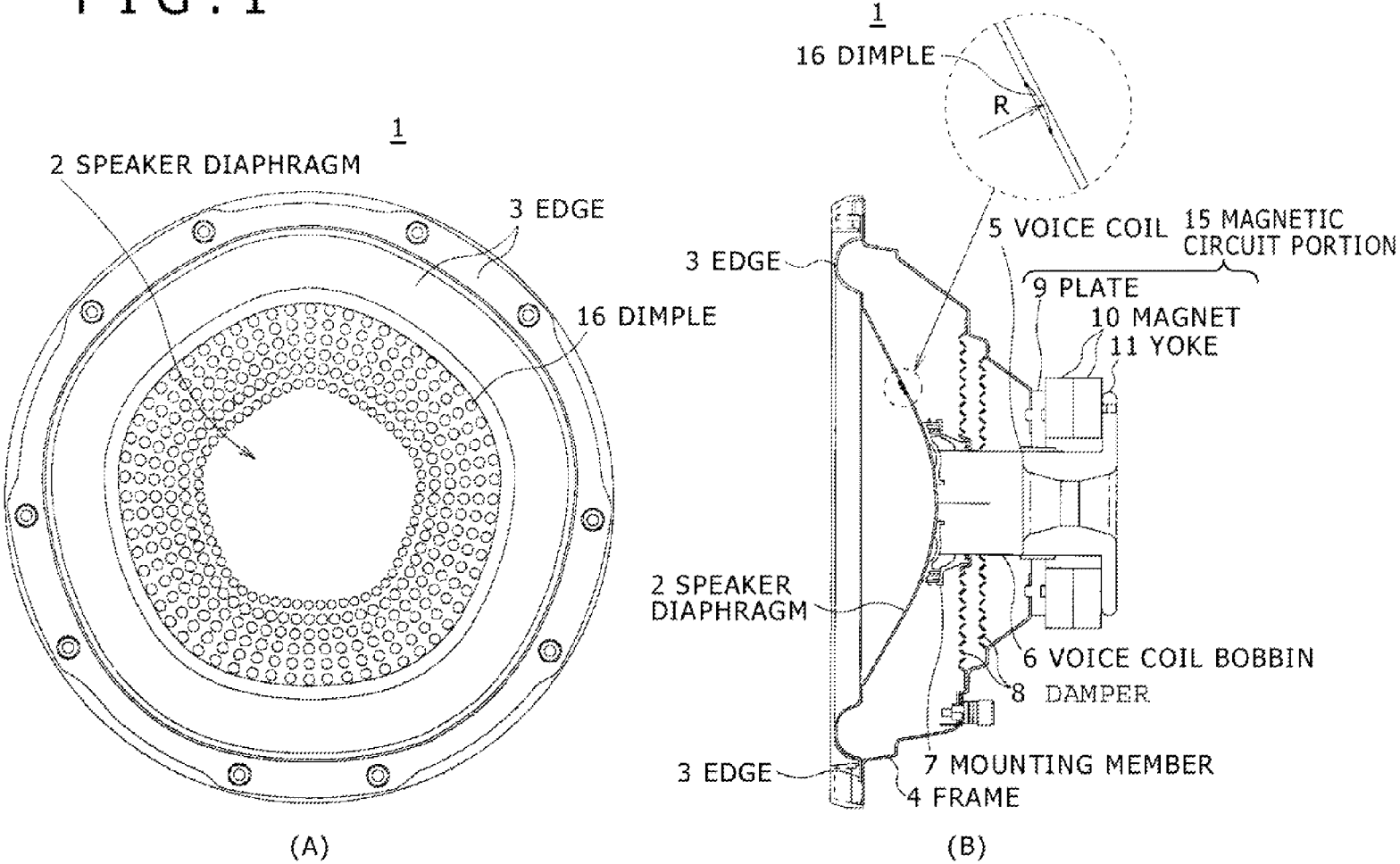
FIG. 1 is a schematic view showing a construction of a speaker device.

In FIGS. 1(A) and (B), 1 entirely designates an in-car speaker device based on that the in-car speaker device is installed within a trunk of a car, or the like. The in-car speaker device is used as a subwoofer for reproduction of a low-frequency band (for example, 5 [Hz] to 400 [Hz]).

This speaker device 1 has a cone-shaped speaker diaphragm 2. The cone-shaped speaker diaphragm 2 is supported by a frame 4 through an edge 3 provided in an outer periphery portion of the cone-shaped speaker diaphragm 2.

In addition, the speaker diaphragm 2 is fixedly mounted to a cylindrical voice coil bobbin 6 around which a voice coil 5 composed of a lead line (not shown) is wound through a mounting member 7, and the voice coil bobbin 6 concerned is supported by the frame 4 through a damper 8.

In addition, in the speaker device 1, a magnetic circuit portion 15 for vibrating back and forth the speaker diaphragm 2 is mounted to a lower end side of the frame 4 in a state of being fixed thereto.

The magnetic circuit portion 15 has a disc-like yoke 11 in which a column-like pole piece is implanted from a center, and a circular ring-shaped magnet 10 is fixedly mounted to the disc-like yoke 11 so as to surround an upper surface outer periphery of the yoke 11 concerned.

In addition, in the magnetic circuit portion 15, a circular ring-shaped plate 9 is fixedly mounted onto the magnet 10 in a state of being laminated on the magnet 10, and the frame 4 is mounted to the plate 9 concerned.

In such a way, in the speaker device 1, when an electromagnetic force is applied to the voice coil 5 of the magnetic circuit portion 15 in accordance with an applied current based on an audio signal supplied thereto from the outside, the voice coil 5 concerned and the magnet 10 attract or repel each other, whereby the speaker diaphragm 2 is vibrated back and forth to generate a sound corresponding to the audio signal.

[1-2. Construction of Speaker Diaphragm]

Next, a detailed construction of the speaker diaphragm 2 will be described. The speaker diaphragm 2 is of a so-called cone-shaped cap-less type, and is formed by so-called insert molding in which polypropylene is filled in a predetermined mold form. It is noted that three kinds of bores: 25 [cm]; 30 [cm]; and 38 [cm] are supposed as a bore (a diameter when viewed from the front surface) of the speaker diaphragm 2.

In addition, the speaker diaphragm 2 is formed so as to have an approximately pentagonal cone type shape, that is, a shape composed of only a side surface portion having an approximately pentagonal truncated cone in which a ridge portion is gentle and a bottom portion (hereinafter this is referred to as an approximately pentagonal cone shape).

As a result, as far as the speaker diaphragm 2 concerned, portions of reverse vibration when division vibration is caused are set as five portions (that is, an odd-numbered portions), and reverse vibration portions can be prevented from being located on a diagonal line. Therefore, resonance is previously prevented from being caused, and thus degradation in a sound quality can be suppressed.

In addition, in the speaker diaphragm 2, plural dimples 16 which are disposed so as to radially extend from a center side toward an outer periphery side are formed in a front surface thereof. However, any of the dimples 16 concerned is not formed at a central portion on the most inner periphery side, and the central portion on the most inner periphery side is used as a spacer for a notation such as a brand name or a logo.

Figure 2:
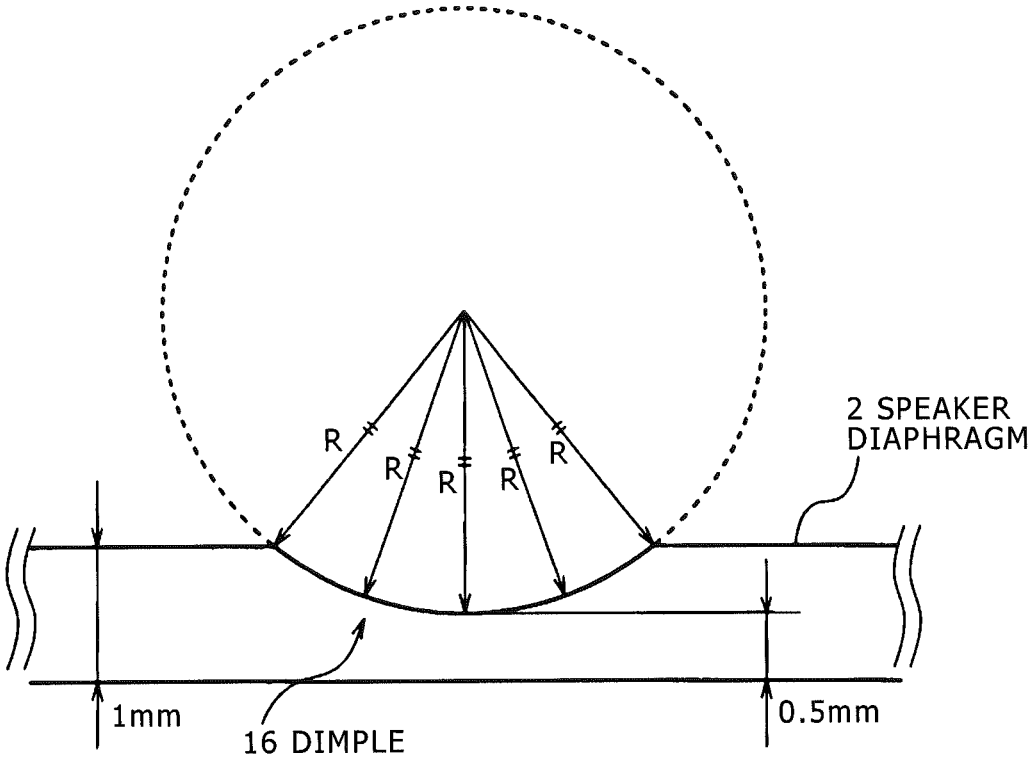
FIG. 2 is a schematic cross sectional view showing a cross sectional structure of a dimple.

As shown in FIG. 2, actually, as far as the dimple 16, a thickness of the speaker diaphragm 2 is 1 [mm], and is grinded down so as to become 0.5 [mm] at which a depth of the dimple 16 becomes ½. Thus, the weight saving is realized by a concave portion as far as the speaker diaphragm 2.

The shape of the dimple 16 is a shape itself of a dent when a spherical body (indicated by a broken line) is pressed. Thus, radii R of curvature when the dimple 16 is formed become equal to one another in any of the places because of the spherical body.

In addition, the dimple 16 has a so-called arch structure in which the radii R of curvature of surface in which the dimple 16 is formed are equal to one another in any of the places. For this reason, the dimple 16 has structural characteristics in which a stress is dispersed. Therefore, although the thickness of the speaker diaphragm 2 is halved to ½ because the dimple 16 is formed, the speaker diaphragm 2 can maintain the high rigidity comparable to that before the dimple 16 is formed.

As a result, although the speaker diaphragm 2 is not a general one known in the past, having an equal thickness, such that a convex portion is formed on a side opposite to a concave portion in which the dimple 16 is formed, the weight saving can be reliably realized by the concave portion while the speaker diaphragm 2 maintains the high rigidity comparable to that before the dimple 16 is formed.

In addition, the dimple 16 is formed in such a way that a diameter on the outer periphery side (up to the fourth column from the outer periphery side) is 6 [mm]. Although this is an optimal size when the thickness of the speaker diaphragm 2 is 1 [mm], and 0.5 [mm] at which the depth of the dimple 16 concerned becomes ½ of the thickness is attempted to be ensured, the present invention is by no means necessarily limited thereto. For example, the diameter may be either 5 [mm] or 7 [mm].

Likewise, the dimple 16 is formed in such a way the diameter becomes 5 [mm] in a column on the most inner periphery side. As a result, as far as the speaker diaphragm 2 concerned, the dimples adjacent to one another on the most inner periphery side are avoided from being superposed on one upon another, and thus the arch structure can be ensured for any of the dimples 16.

Figure 3:
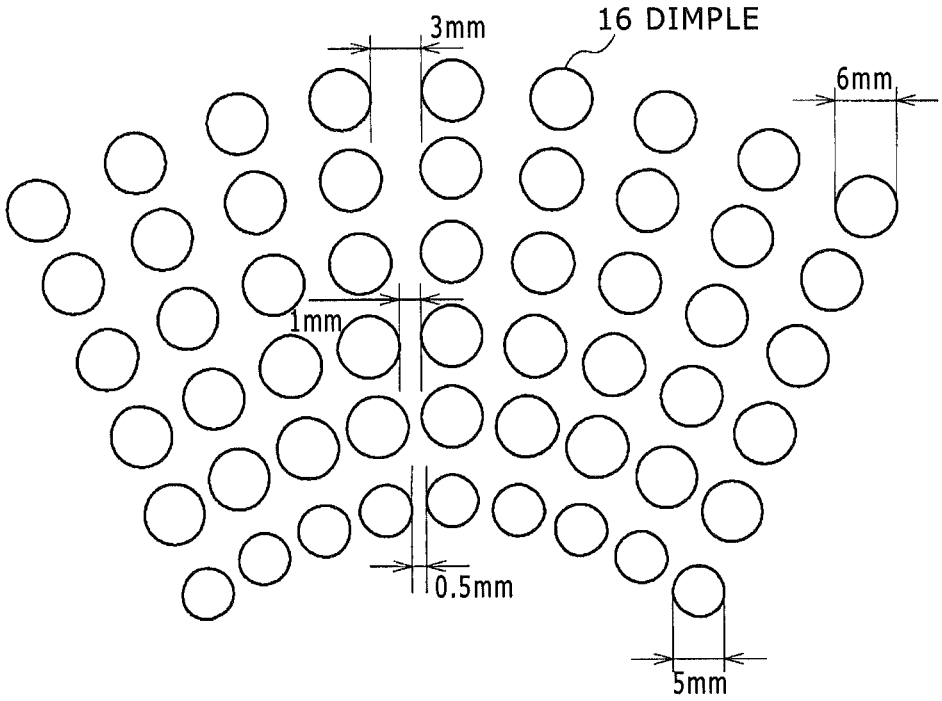
FIG. 3 is a diagram showing an arrangement of the dimples.

In addition, as shown in FIG. 3, in the speaker diaphragm 2, a pitch of the plural dimples 16 disposed on the most outer periphery side is about 3 [mm], whereas the pitch becomes gradually narrow toward the most inner periphery side so as to become about 1 [mm], about 0.5 [mm], and the like.

The reason for this is because the outer periphery side is weak in terms of the rigidity although the inner periphery side of the speaker diaphragm 2 is strong in terms of the rigidity, and thus it is necessary to prevent the rigidity from deteriorating by leaving many portions in each of which any of the dimples 16 is not formed on the outer periphery side.

In such a manner, in the speaker diaphragm 2, plural dimples 16 each having the arch structure are radially disposed in the front surface from the center side toward the outer periphery side, whereby the weight of the speaker diaphragm 2 itself can be reduced. Therefore, it is possible to increase the maximum sound pressure when the speaker diaphragm 2 is vibrated by the magnetic circuit portion 15.

In addition, although the dimples 16 for the weight saving are formed in the front surface of the speaker diaphragm 2, since each of the dimples 16 has the arch structure, the high rigidity can be approximately maintained even as compared with the case before the dimples 16 are formed, it is possible to realize the compatibility of the weight saving and the high rigidity.

[1-3. Variation of Speaker Diaphragm]

Now, as far as the speaker diaphragm 2 concerned, as described above, the case where the plural dimples 16 are formed in the front surface of the speaker diaphragm 2 has been described. However, a speaker diaphragm in which plural dimples 16 are formed in a back surface thereof is also devised.

It is noted that since basic constructions of the frame 4, the mounting member 7, the dumper 8, the magnetic circuit portion 15, and the like are the same as those in the speaker device 1 (FIG. 1), a description thereof is omitted here for the sake of convenience.

Figure 4:
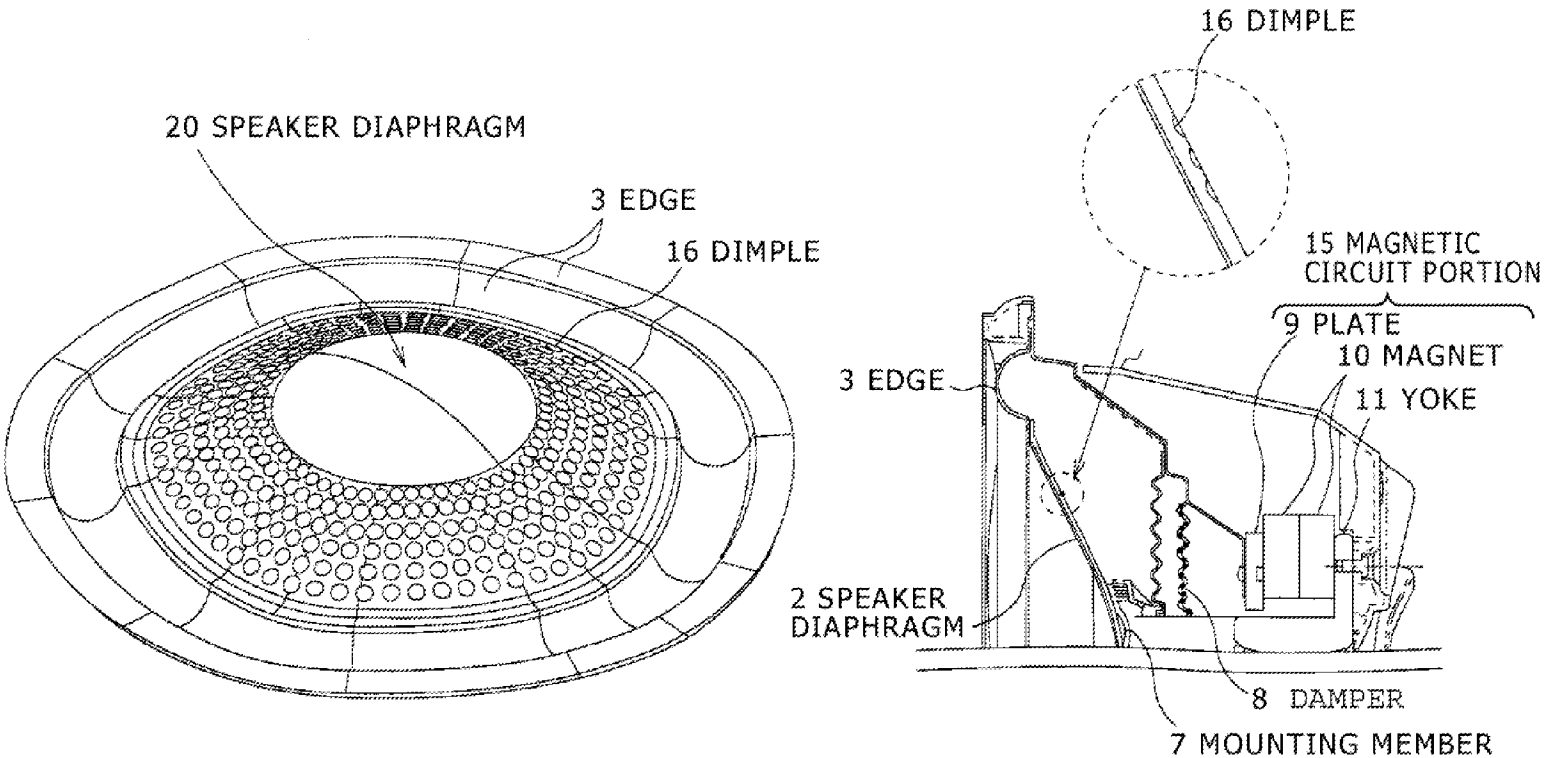
FIG. 4 is a schematic view showing a variation of a speaker diaphragm.

As shown in FIGS. 4(A) and (B) in which portions corresponding to those in FIGS. 1(A) and (B) are designated by the same reference numerals, respectively, 20 designates a speaker diaphragm which is devised as a variation of the speaker diaphragm 2. Basically, plural dimples 16 are provided in a back surface of the speaker diaphragm 20.

This speaker diaphragm 20 is also constructed in the form of a cone-like cap-less type, and is formed by the so-called insert molding in which a glass fiber and polypropylene are filled within a predetermined mold form. Also, the glass fiber and polypropylene are fused to be bonded to each other in the insert molding concerned.

As far as the speaker diaphragm 20 in this case, plural dimples 16 are not formed in the front surface of the glass fiber, but are formed in the back surface of polypropylene. It is noted that three kinds of bores: 25 [cm]; 30 [cm]; and 38 [cm] are supposed as the bore as well of the speaker diaphragm 20.

In addition, since the speaker diaphragm 20 is also formed so as to have an approximately pentagonal cone shape, portions of reverse vibration when division vibration is caused are set as five portions (that is, an odd-numbered portions), and reverse vibration portions can be prevented from being located on a diagonal line. Therefore, resonance is previously prevented from being caused, and thus degradation in a sound quality can be suppressed.

In addition, in the speaker diaphragm 20 as well, plural dimples 16 which are disposed so as to radially extend from a center side toward an outer periphery side are formed in a back surface thereof. However, any of the dimples 16 concerned is not formed at a central portion on the most inner periphery side.

However, in the speaker diaphragm 20, because of provision of the dimples 16 in the back surface thereof, a center portion thereof is not used as a space for a notation such as a brand name or a logo. Therefore, naturally, the dimples 16 may be provided at the center portion as well.

In this case, since in the speaker diaphragm 20, the weight can be further reduced as compared with the speaker diaphragm 2 (FIG. 1), the maximum sound pressure can also be increased along with the weight saving.

Figure 5:
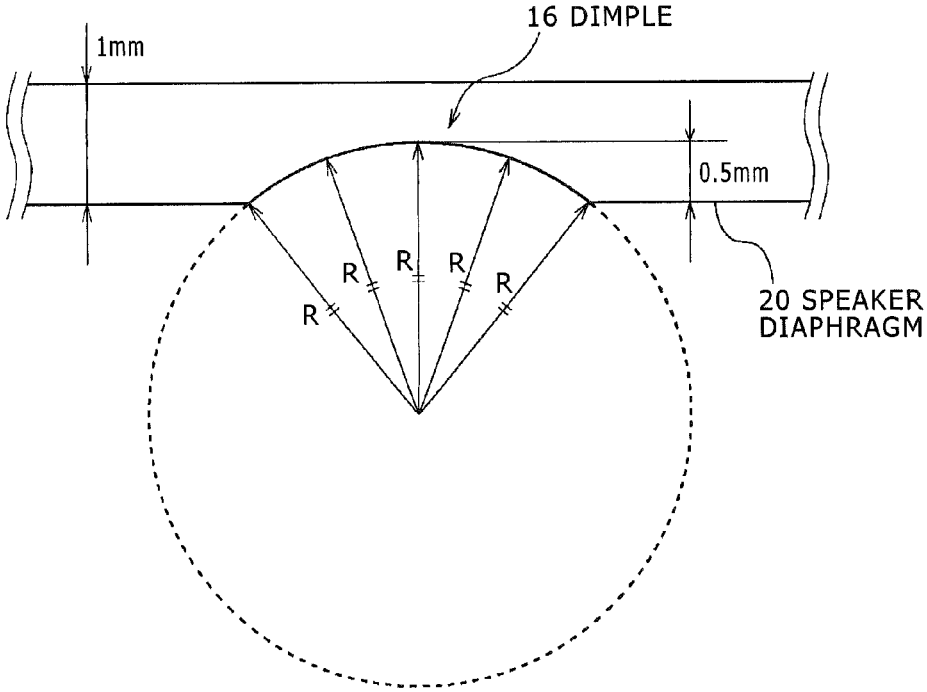
FIG. 5 is a schematic cross sectional view showing a cross-sectional structure of the dimple.

As shown in FIG. 5 in which portions corresponding to those in FIG. 2 are designated with the same reference numerals. Actually, for the dimple 16, a thickness of the speaker diaphragm 20 is 1 [mm], and is grinded down so as to become 0.5 [mm] at which a depth of the dimple 16 becomes ½. Thus, the weight saving is realized by a concave portion as far as the speaker diaphragm 20.

The shape of the dimple 16 is a shape itself of a dent when a spherical body (indicated by a broken line) is pressed. Thus, radii R of curvature when the dimple 16 is formed become equal to one another in any of the places because of the spherical body.

In addition, the dimple 16 has a so-called arch structure in which the radii R of curvature of surface in which the dimple 16 is formed are equal to one another in any of the places. For this reason, the dimple 16 has structural characteristics in which a stress is dispersed. Therefore, although the thickness of the speaker diaphragm 20 is halved to ½ because the dimple 16 is formed, the speaker diaphragm 20 can maintain the high rigidity comparable to that before the dimple 16 is formed.

As a result, although the speaker diaphragm 20 is not a general one known in the past, having an equal thickness, such that a convex portion is formed in a side opposite to a concave portion in which the dimple 16 is formed, the weight saving can be reliably realized by the concave portion while the speaker diaphragm 20 maintains the high rigidity comparable to that before the dimple 16 is formed.

In addition, the dimple 16 is formed in such a way that a diameter on the outer periphery side (up to the fourth column from the outer periphery side) is 6 [mm]. Although this is an optimal size when the thickness of the speaker diaphragm 2 is 1 [mm], and 0.5 [mm] at which the depth of the dimple 16 concerned becomes ½ of the thickness is attempted to be ensured, the present invention is by no means necessarily limited thereto. For example, the diameter may be either 5 [mm] or 7 [mm].

Likewise, the dimple 16 is formed in such a way the diameter becomes 5 [mm] in a column on the most inner periphery side. As a result, as far as the speaker diaphragm 2, the dimples 16 adjacent to one another on the most inner periphery side are avoided from being superposed on one upon another, and thus the arch structure can be ensured for any of the dimples 16.

In addition, as shown in FIG. 3, in the speaker diaphragm 20, a pitch of the plural dimples 16 disposed on the most outer periphery side is about 3 [mm], whereas the pitch becomes gradually narrow toward the most inner periphery side so as to become about 1 [mm], about 0.5 [mm], and the like.

The reason for this is because the outer periphery side is weak in terms of the rigidity although the inner periphery side of the speaker diaphragm 20 is strong in terms of the rigidity, and thus it is necessary to prevent the rigidity from deteriorating by leaving many portions in each of which any of the dimples 16 is not formed in the outer periphery side.

In such a manner, in the speaker diaphragm 20, plural dimples 16 each having the arch structure are radially disposed in the back surface from the center side toward the most outer periphery side, whereby the weight of the speaker diaphragm 20 itself can be reduced. Therefore, it is possible to increase the maximum sound pressure when the speaker diaphragm 20 is vibrated by the magnetic circuit portion 15.

In addition, although the dimples 16 for the weight saving are formed in the back surface of the speaker diaphragm 20, since each of the dimples 16 has the arch structure, the high rigidity can be approximately maintained even as compared with the case before the dimples 16 are formed, it is possible to realize the compatibility of the weight saving and the high rigidity.

[1-4. Simulation Results]

Figure 6:
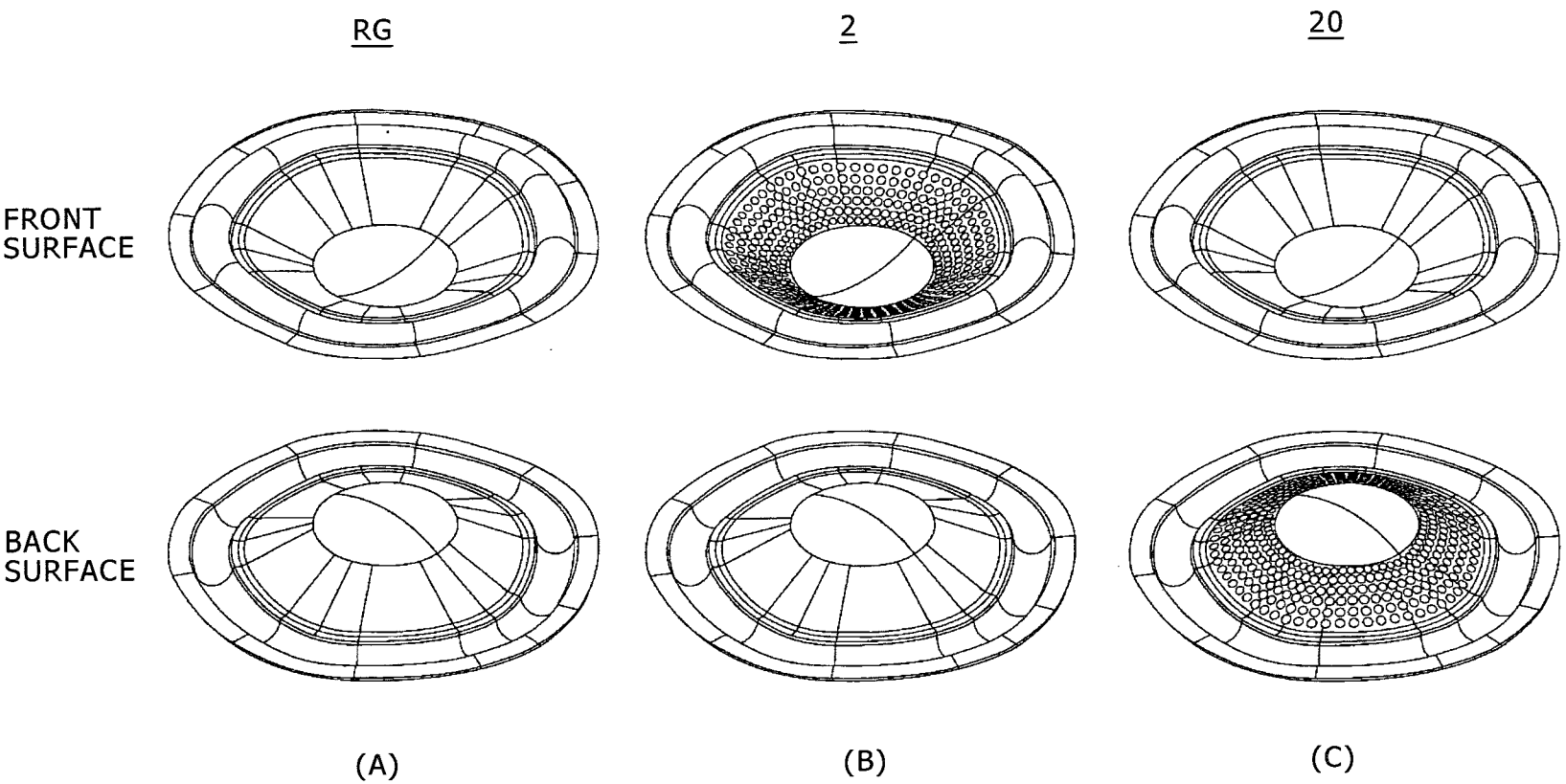
FIG. 6 is a schematic view showing three kinds of analytical modules: (A) no dimple; (B) front surface dimple; and (C) back surface dimple.

Next, as shown in FIGS. 6(A), (B), and (C), three kinds of analytical models corresponding to a speaker diaphragm RG in which any of the dimples 16 is not provided, the speaker diaphragm 2 in which the dimples 16 are formed in the front surface, and the speaker diaphragm 20 in which the dimples 16 are formed in the back surface, respectively, are prepared, and an amount of displacement when a stress is applied from the outside is simulated by using a computer.

In this case, results of verification for size differences are obtained with respect to three kinds of bores: 25 [cm]; 30 [cm]; and 38 [cm] by utilizing a finite element method using the computer. It is noted that as far as the stress applied from the outside, there are the case where a given static load is applied, and the case where a given vibration is applied like when actually, the speaker diaphragm outputs a sound. Thus, the simulations were carried out for the two cases, correspondingly.

Figure 7:
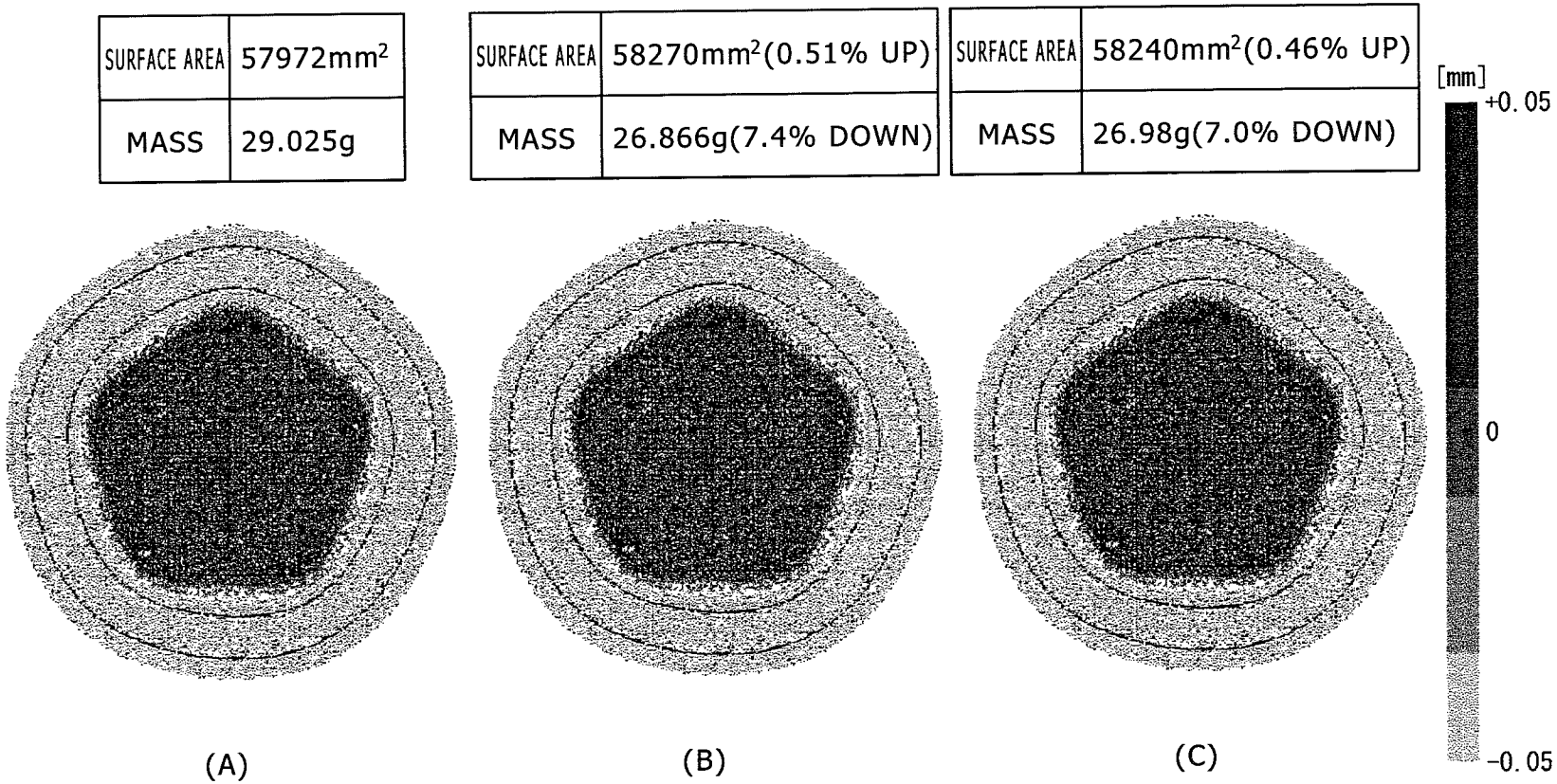
FIG. 7 is a schematic view showing results of simulations when in a bore of 25 cm, a static load is applied in: (A) no dimple; (B) front surface dimple; and (C) back surface dimple.

Actually, as shown in FIGS. 7(A), (B), and (C), amounts of displacement when a given static load is applied to the speaker diaphragm RG having no dimple, the speaker diaphragm 2 having the front surface dimples, and the speaker diaphragm 20 having the back surface dimples, each having the bore of 25 [cm], are displayed and color-coded with the range of ±0.05 [mm].

In this case, in all of the speaker diaphragm RG having no dimple, the speaker diaphragm 2 having the front surface dimples, and the speaker diaphragm 20 having the back surface dimples, the simulation results based on the same color distribution are obtained. That is to say, it is understood that a difference in rigidity is not seen because the slight amounts of displacement are equal to one another irrespective of presence or absence of the dimples, or the front surface or back surface of the speaker diaphragm.

It is noted that as compared with a front surface area of 57972 [$mm^2$] and a mass of 29.025 [g] in the speaker diaphragm RG having no dimple, a surface area and a mass of the speaker diaphragm 2 having the front surface dimples are 58270 [$mm^2$] and 26.866 [g], respectively, and thus the surface area is increased by 0.51% and the mass is reduced by 7.4%.

Likewise, as compared with the front surface area of 57972 [$mm^2$] and the mass of 29.025 [g] in the speaker diaphragm RG having no dimple, a surface area and a mass of the speaker diaphragm 20 having the back surface dimples are 58240 [$mm^2$] and 26.98 [g], respectively, and thus the surface area is increased by 0.46% and the mass is reduced by 7.0%.

That is to say, it is understood that as compared with the speaker diaphragm RG having no dimple, with regard to the speaker diaphragm 2 having the front surface dimples, and the speaker diaphragm 20 having the back surface dimples, the surface area is increased by 0.46% to 0.51%, and the mass is reduced by 7.0% to 7.4% due to the presence of the dimples 16.

Figure 8:
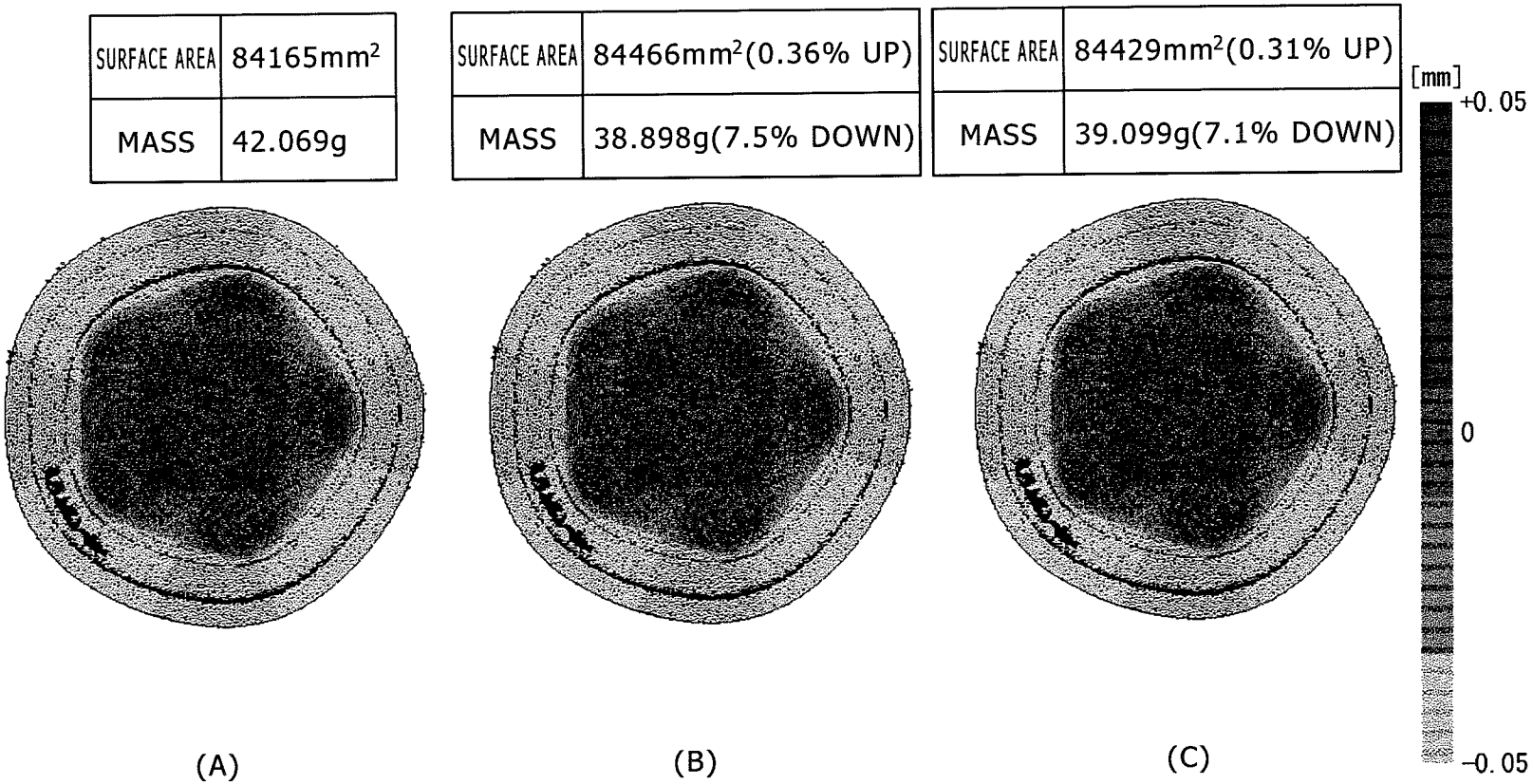
FIG. 8 is a schematic view showing results of simulations when in a bore of 30 cm, a static load is applied in: (A) no dimple; (B) front surface dimple; and (C) back surface dimple.

As shown in FIG. 8, amounts of displacement when a given static load is applied to the speaker diaphragm RG having no dimple, the speaker diaphragm 2 having the front surface dimples, and the speaker diaphragm 20 having the back surface dimples, each having the bore of 30 [cm], are displayed and color-coded with the range of ±0.05 [mm].

In this case, in all of the speaker diaphragm RG having no dimple, the speaker diaphragm 2 having the front surface dimples, and the speaker diaphragm 20 having the back surface dimples, the simulation results based on the same color distribution are obtained. That is to say, it is understood that a difference in rigidity is not seen because the slight amounts of displacement are equal to one another irrespective of presence or absence of the dimples, or the front surface or back surface of the speaker diaphragm.

It is noted that as compared with a front surface area of 84165 [$mm^2$] and a mass of 42.069 [g] in the speaker diaphragm RG having no dimple, a surface area and a mass of the speaker diaphragm 2 having the front surface dimples are 84466 [$mm^2$] and 38.898 [g], respectively, and thus the surface area is increased by 0.36% and the mass is reduced by 7.5%.

Likewise, as compared with the front surface area of 84165 [$mm^2$] and the mass of 42.069 [g] in the speaker diaphragm RG having no dimple, a surface area and a mass of the speaker diaphragm 20 having the back surface dimples are 84429 [$mm^2$] and 39.099 [g], respectively, and thus the surface area is increased by 0.31% and the mass is reduced by 7.1%.

That is to say, it is understood that as compared with the speaker diaphragm RG having no dimple, with regard to the speaker diaphragm 2 having the front surface dimples, and the speaker diaphragm 20 having the back surface dimples, the surface area is increased by 0.31% to 0.36%, and the mass is reduced by 7.1% to 7.5% due to the presence of the dimples 16.

Figure 9:
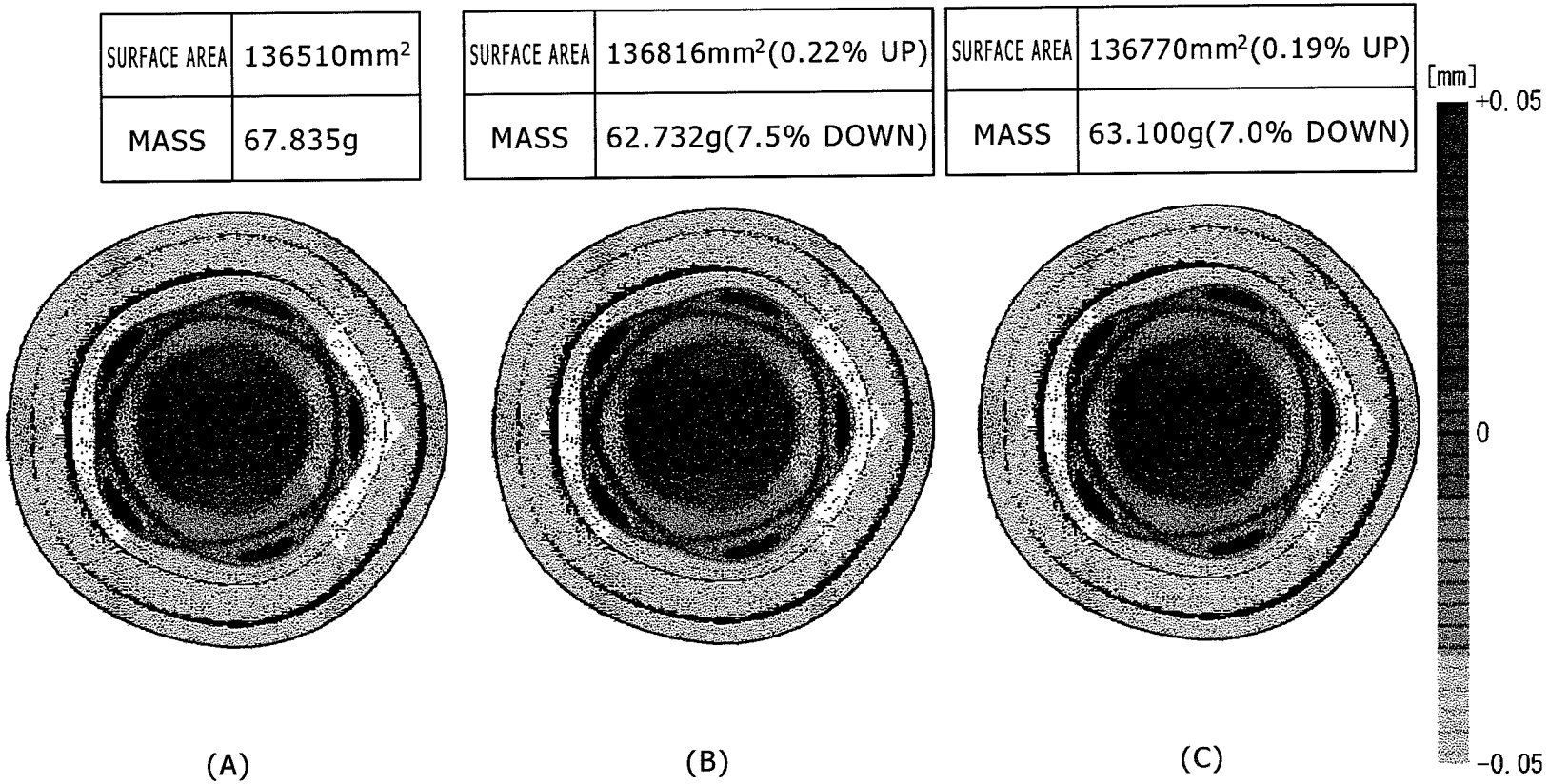
FIG. 9 is a schematic view showing results of simulations when in a bore of 38 cm, a static load is applied in: (A) no dimple; (B) front surface dimple; and (C) back surface dimple.

As shown in FIG. 9, amounts of displacement when a given static load is applied to the speaker diaphragm RG having no dimple, the speaker diaphragm 2 having the front surface dimples, and the speaker diaphragm 20 having the back surface dimples, each having the bore of 38 [cm], are displayed and color-coded with the range of ±0.05 [mm] as in the above cases.

In this case, in all of the speaker diaphragm RG having no dimple, the speaker diaphragm 2 having the front surface dimples, and the speaker diaphragm 20 having the back surface dimples, the simulation results based on the same color distribution are obtained. That is to say, it is understood that a difference in rigidity is not seen because the slight amounts of displacement are equal to one another irrespective of presence or absence of the dimples, or the front surface or back surface of the speaker diaphragm.

However, in this case, since the bore is as large as 38 [cm], and the rigidity becomes weak as the position is located in the outer periphery side, displacement nonuniformity becomes large, and an area having a large amount of displacement appears in a part of the most outer periphery side.

It is noted that as compared with a front surface area of 136510 [$mm^2$] and a mass of 67.835 [g] in the speaker diaphragm RG having no dimple, the surface area and the mass of the speaker diaphragm 2 having the front surface dimples are 136816 [$mm^2$] and 62.732 [g], respectively, and thus the surface area is increased by 0.22% and the mass is reduced by 7.5%.

Likewise, as compared with the front surface area of 136510 [$mm^2$] and the mass of 67.835 [g] in the speaker diaphragm RG having no dimple, the surface area and the mass of the speaker diaphragm 20 having the back surface dimples are 136770 [$mm^2$] and 63.100 [g], respectively, and thus the surface area is increased by 0.19% and the mass is reduced by 7.0%.

That is to say, it is understood that as compared with the speaker diaphragm RG having no dimple, with regard to the speaker diaphragm 2 having the front surface dimples, and the speaker diaphragm 20 having the back surface dimples, the surface area is increased by 0.19% to 0.22%, and the mass is reduced by 7.0% to 7.5% due to the presence of the dimples 16.

Figure 10:
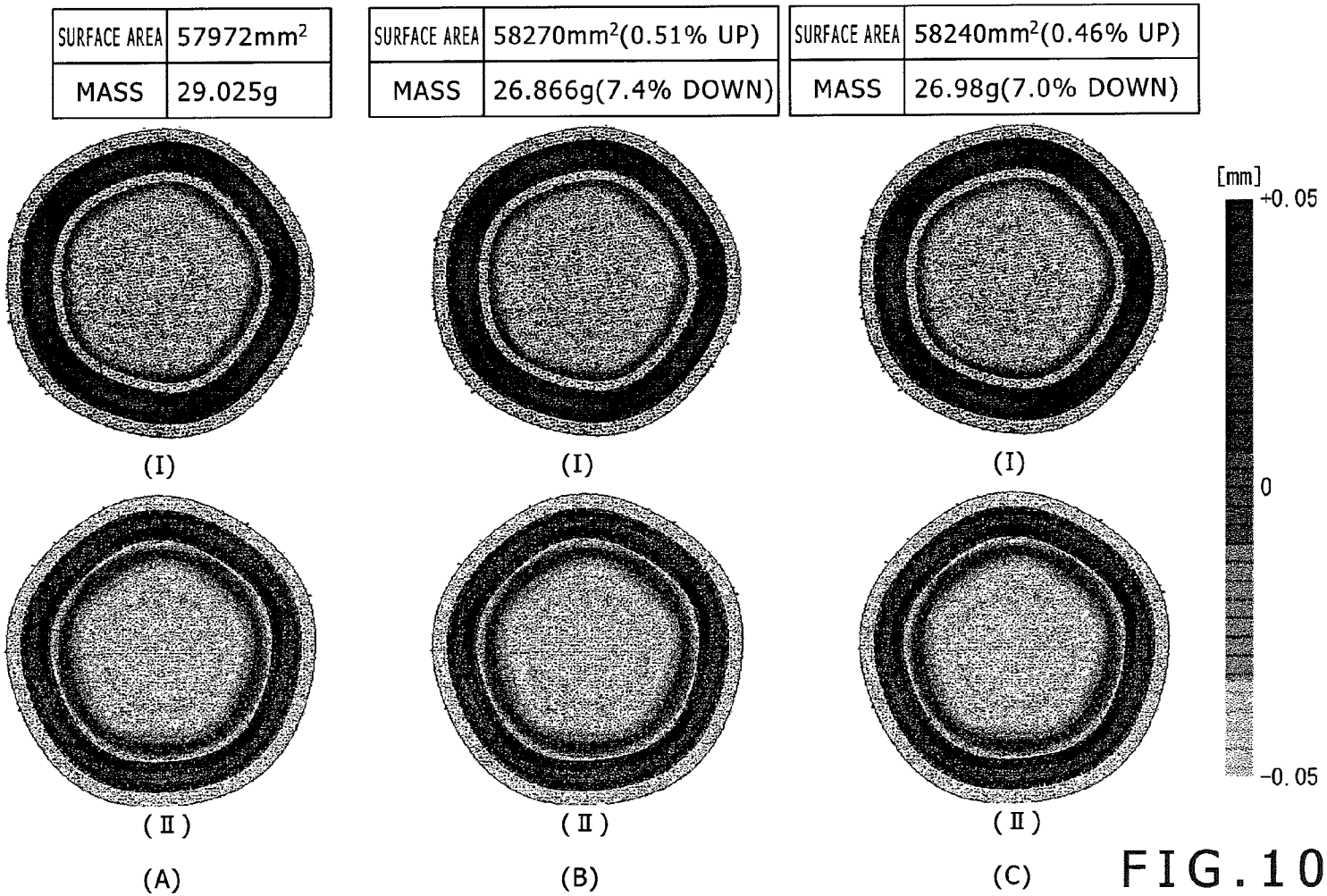
FIG. 10 is a schematic view showing results of simulations when in the bore of 25 cm, a given vibration is applied to each of (I) front surfaces and (II) back surfaces in: (A) no dimple; (B) front surface dimple; and (C) back surface dimple.

Now, as shown in FIG. 10, amounts of displacement when a given vibration is applied to the speaker diaphragm RG having no dimple, the speaker diaphragm 2 having the front surface dimples, and the speaker diaphragm 20 having the back surface dimples, each having the bore of 25 [cm], are displayed and color-coded with the range of ±0.05 [mm].

In this case, in all of the speaker diaphragm RG having no dimple, the speaker diaphragm 2 having the front surface dimples, and the speaker diaphragm 20 having the back surface dimples, the simulation results based on the same color distribution are obtained. That is to say, it is understood that a difference in rigidity is not seen because the slight amounts of displacement are equal to one another irrespective of presence or absence of the dimples, or the front surface or back surface of the speaker diaphragm.

It is noted that as compared with a surface area of 57972 [$mm^2$] and a mass of 29.025 [g] in the speaker diaphragm RG having no dimple, a surface area and a mass of the speaker diaphragm 2 having the front surface dimples are 58270 [$mm^2$] and 26.866 [g], respectively, and thus the surface area is increased by 0.51% and the mass is reduced by 7.4%.

Likewise, as compared with the surface area of 57972 [$mm^2$] and the mass of 29.025 [g] in the speaker diaphragm RG having no dimple, a surface area and a mass of the speaker diaphragm 20 having the back surface dimples are 58240 [$mm^2$] and 26.98 [g], respectively, and thus the surface area is increased by 0.46% and the mass is reduced by 7.0%.

That is to say, it is understood that as compared with the speaker diaphragm RG having no dimple, with regard to the speaker diaphragm 2 having the front surface dimples, and the speaker diaphragm 20 having the back surface dimples, the surface area is increased by 0.46% to 0.51%, and the mass is reduced by 7.0% to 7.4% due to the presence of the dimples 16.

Figure 11:
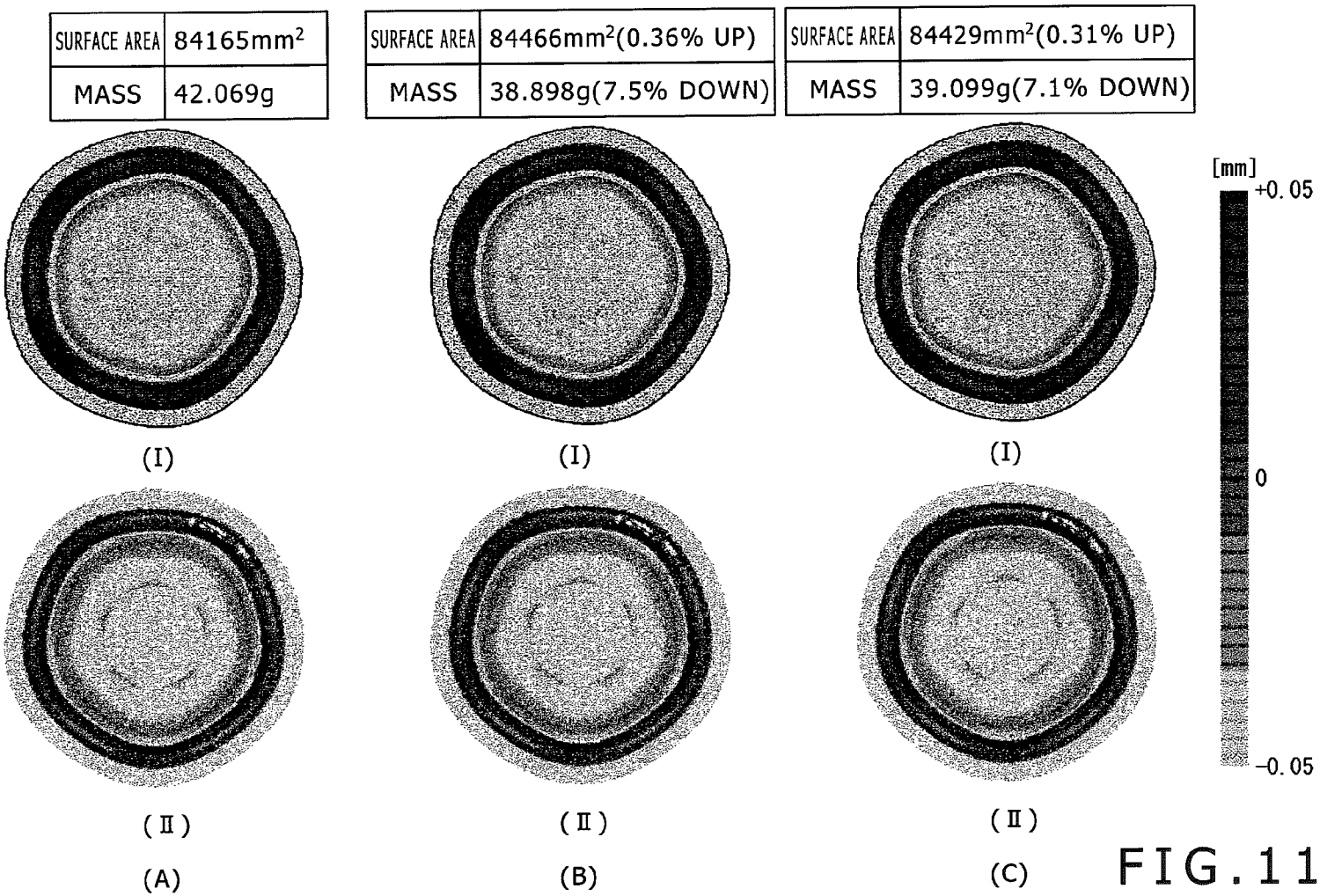
FIG. 11 is a schematic view showing results of simulations when in the bore of 30 cm, a given vibration is applied to each of (I) front surfaces and (II) back surfaces in: (A) no dimple; (B) front surface dimple; and (C) back surface dimple.

As shown in FIG. 11, amounts of displacement when a given vibration is applied to the speaker diaphragm RG having no dimple, the speaker diaphragm 2 having the front surface dimples, and the speaker diaphragm 20 having the back surface dimples, each having the bore of 30 [cm], are displayed and color-coded with the range of ±0.05 [mm].

In this case, in all of the speaker diaphragm RG having no dimple, the speaker diaphragm 2 having the front surface dimples, and the speaker diaphragm 20 having the back surface dimples, the simulation results based on the same color distribution are obtained. That is to say, it is understood that a difference in rigidity is not seen because the slight amounts of displacement are equal to one another irrespective of presence or absence of the dimples, or the front surface or back surface of the speaker diaphragm.

It is noted that as compared with a front surface area of 84165 [$mm^2$] and a mass of 42.069 [g] in the speaker diaphragm RG having no dimple, a surface area and a mass of the speaker diaphragm 2 having the front surface dimples are 84466 [$mm^2$] and 38.898 [g], respectively, and thus the surface area is increased by 0.36% and the mass is reduced by 7.5%.

Likewise, as compared with the surface area of 84165 [$mm^2$] and the mass of 42.069 [g] in the speaker diaphragm RG having no dimple, a surface area and a mass of the speaker diaphragm 20 having the back surface dimples are 84429 [$mm^2$] and 39.099 [g], respectively, and thus the surface area is increased by 0.31% and the mass is reduced by 7.1%.

That is to say, it is understood that as compared with the speaker diaphragm RG having no dimple, with regard to the speaker diaphragm 2 having the front surface dimples, and the speaker diaphragm 20 having the back surface dimples, the surface area is increased by 0.31% to 0.36%, and the mass is reduced by 7.1% to 7.5% due to the presence of the dimples 16.

Figure 12:
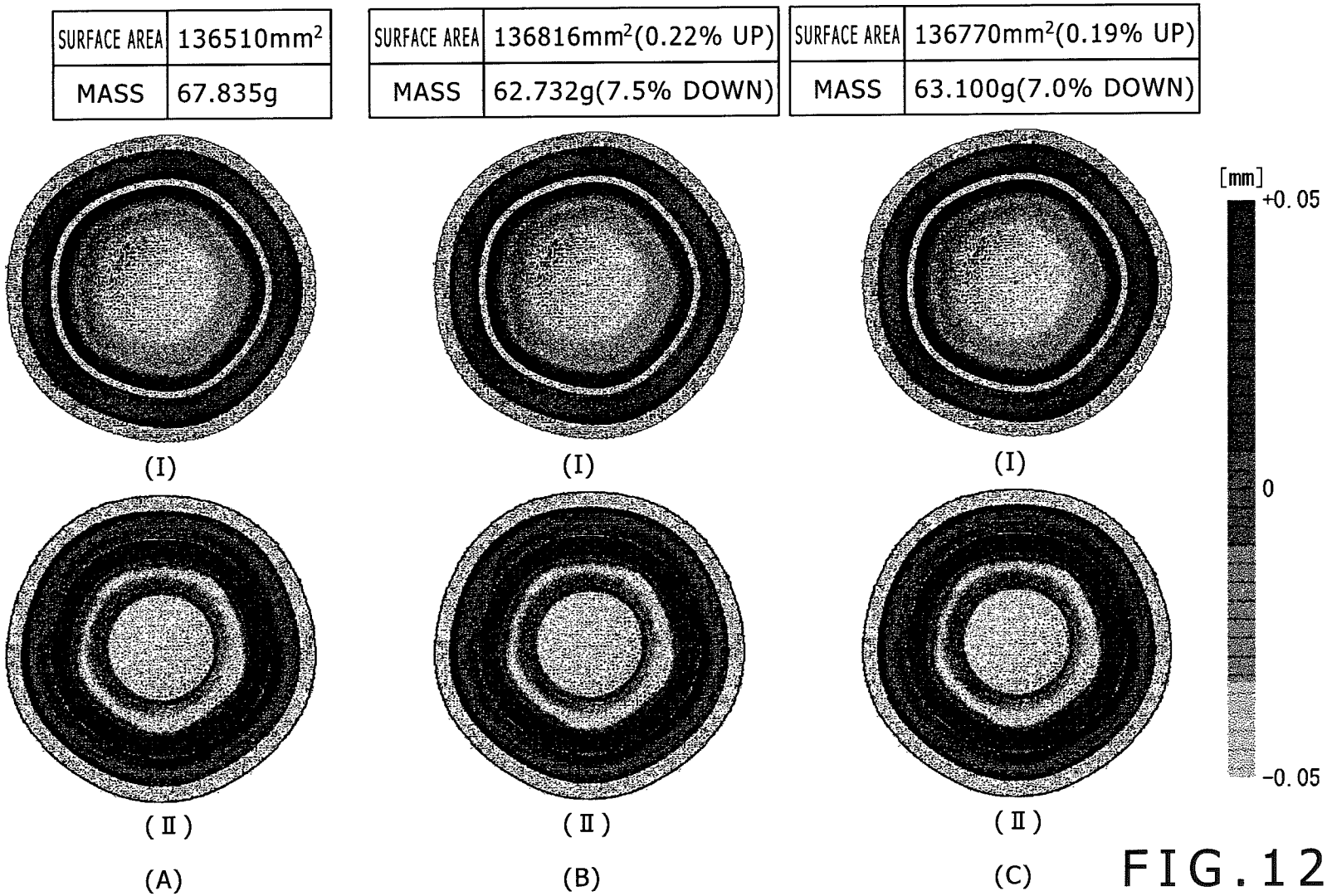
FIG. 12 is a schematic view showing results of simulations when in the bore of 38 cm, a given vibration is applied to each of (I) front surfaces and (II) back surfaces in: (A) no dimple; (B) front surface dimple; and (C) back surface dimple.

As shown in FIG. 12, amounts of displacement when a given vibration is applied to the speaker diaphragm RG having no dimple, the speaker diaphragm 2 having the front surface dimples, and the speaker diaphragm 20 having the back surface dimples, each having the bore of 38 [cm], are displayed and color-coded with the range of ±0.05 [mm] as in the above cases.

In this case, in all of the speaker diaphragm RG having no dimple, the speaker diaphragm 2 having the front surface dimples, and the speaker diaphragm 20 having the back surface dimples, the simulation results based on the same color distribution are obtained. That is to say, it is understood that a difference in rigidity is not seen because the slight amounts of displacement are equal to one another irrespective of presence or absence of the dimples, or the front surface or back surface of the speaker diaphragm.

However, in this case, since the bore is as large as 38 [cm], and the rigidity becomes weak as the position is located in the outer periphery side, displacement nonuniformity becomes large, and an area having a large amount of displacement appears in a part of the most outer periphery side.

It is noted that as compared with a surface area of 136510 [$mm^2$] and a mass of 67.835 [g] in the speaker diaphragm RG having no dimple, a surface area and a mass of the speaker diaphragm 2 having the front surface dimples are 136816 [$mm^2$] and 62.732 [g], respectively, and thus the surface area is increased by 0.22% and the mass is reduced by 7.5%.

Likewise, as compared with the front surface area of 136510 [$mm^2$] and the mass of 67.835 [g] in the speaker diaphragm RG having no dimple, the surface area and the mass of the speaker diaphragm 20 having the back surface dimples are 136770 [$mm^2$] and 63.100 [g], respectively, and thus the surface area is increased by 0.19% and the mass is reduced by 7.0%.

That is to say, it is understood that as compared with the speaker diaphragm RG having no dimple, with regard to the speaker diaphragm 2 having the front surface dimples, and the speaker diaphragm 20 having the back surface dimples, the surface area is increased by 0.19% to 0.22%, and the mass is reduced by 7.0% to 7.5% due to the presence of the dimples 16.

It is understood that the displacement nonuniformity and the amounts of displacements when the static load or the given vibration is applied to the speaker diaphragm RG having no dimple, the speaker diaphragm 2 having the front surface dimples, and the speaker diaphragm 20 having the back surface dimples in such a manner are equal to one another in any of the bores and thus there is no difference in the rigidity.

That is to say, this means that in all of the speaker diaphragm RG having no dimple, the speaker diaphragm 2 having the front surface dimples, and the speaker diaphragm 20 having the back surface dimples, the rigidity is not largely changed irrespective of the size of the bore, and thus the high rigidity is maintained.

In addition thereto, as compared with the speaker diaphragm RG having no dimple, with regard to the speaker diaphragm 2 having the front surface dimples, and the speaker diaphragm 20 having the back surface dimples, the plural dimples 16 are provided, and as a result, the surface area is increased and the mass is reduced. As a result, the sound pressure level can be increased as compared with the speaker diaphragm having no dimple.

[1-5. Change in Maximum Sound Pressure]

Figure 13:
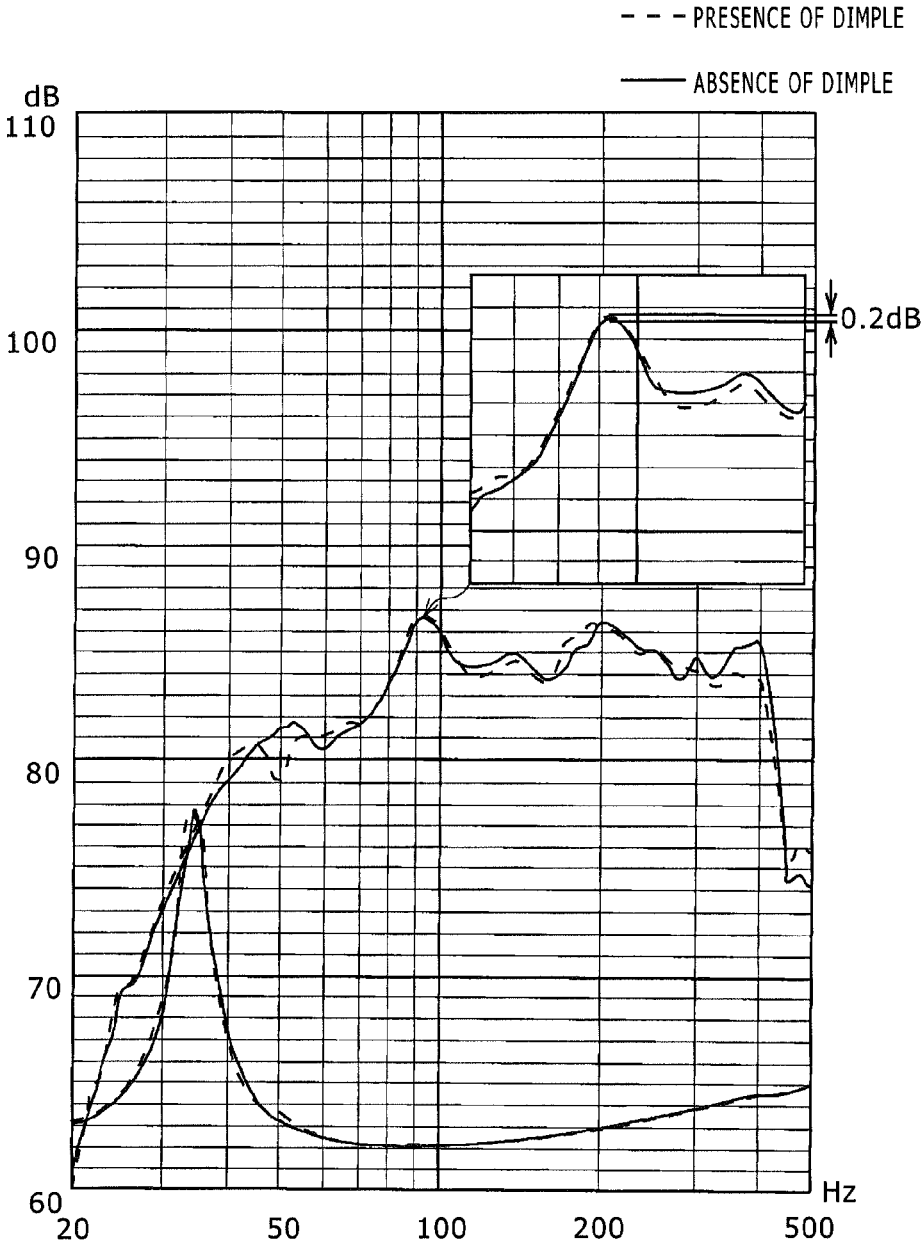
FIG. 13 is a schematic diagram showing sound pressure levels corresponding to presence and absence of the dimples, respectively.

As shown in FIG. 13, in the results of comparison in the sound pressure level between the speaker diaphragm RG having no dimple when the bore, for example, is 25 [cm], and the speaker diaphragm 2 having the front surface dimples when the bore, for example, is 25 [cm], it is understood that the maximum sound pressure level in the speaker diaphragm 2 having the front surface dimples exceeds that in the speaker diaphragm RG having no dimple by about 0.2 [dB] in the vicinity of about 100 [Hz].

As long as it is obvious that the surface area becomes large in presence of the dimples than in absence of the dimple and the weight is further reduced in presence of the dimples than in absence of the dimple, such a difference in the maximum sound pressure level is necessarily caused due to the presence of the dimples 16 irrespective of the front surface and the back surface when the bore is 30 [cm] or 38 [cm].

[1-6. Operation and Effects]

With the construction described above, in each of the speaker diaphragm 2 having the front surface dimples and the speaker diaphragm 20 having the back surface dimples each used in the speaker device 1, by the provision of the plural dimples 16, the surface area thereof can be increased and the weight thereof can be reduced.

As a result, since in the speaker device 1, in each of the speaker diaphragm 2 having the front surface dimples and the speaker diaphragm 20 having the back surface dimples, the surface area thereof is increased and the mass thereof is reduced, as far as the sound pressure level when the vibration is applied by the same magnetic circuit portion 15, the sound pressure level can be reliably increased.

At this time, in the speaker device 1, each of the plural dimples which are provided in each of the speaker diaphragm 2 having the front surface dimples, and the speaker diaphragm 20 having the back surface dimples has the arch structure with which the stress is dispersed. Therefore, although the dimples 16 are formed, so that the thickness is halved to ½, the high rigidity comparable to that before the dimples 16 are formed can be maintained.

According to the constitution described above, the speaker device 1 can realize the increasing of the surface area, and the weight saving by the plural dimples 16, and thus can reliably increase the maximum sound pressure level while the high rigidity is maintained by using either the speaker diaphragm 2 having the front surface dimples, or the speaker diaphragm 20 having the back surface dimples.

<2. Other Embodiments>

It is noted that in the embodiment described above, the description has been given with respect to the case where either the speaker diaphragm 2 or the speaker diaphragm 20 which is formed so as to have the approximately pentagonal cone shape is used. However, the present invention is by no means limited thereto, and thus there may also be used any of speaker diaphragms which are formed so as to have other various kinds of shapes such as a circular shape, an elliptical shape, and a rectangular shape.

In addition, in the embodiment described above, the description has been given with respect to the case where any of the dimples 16 is not formed at the central portion on the most inner periphery side in each of the speaker diaphragm 2 and the speaker diaphragm 20 in order to use the central portion as the space of the notation such as the brand name or the logo. However, the present invention is by no means limited thereto, and thus the dimples 16 may be formed at the entire central portion as well on the most inner periphery side in the speaker diaphragm 2. In this case, as far as each of the speaker diaphragm 2 and the speaker diaphragm 20, the weight thereof is further reduced and thus the sound pressure can be increased.

In addition, in the embodiment described above, the description has been given with respect to the case where the size of the speaker diaphragm 2 is intended for the three kinds of diameters: about 25 [cm]; about 30 [cm]; and about 38 [cm]. However, the present invention is by no means limited thereto, and thus the size of the speaker diaphragm may also be intended for other speaker diaphragms having various kinds of diameters, correspondingly.

In addition, in the embodiment described above, the description has been given with respect to the case where the speaker diaphragm 2 and the speaker diaphragm 20 which are obtained through the molding using polypropylene. However, the present invention is by no means limited thereto, and thus any of speaker diaphragms made of other various kinds of materials such as carbon, a resin, and a paper may also be used.

In addition, in the embodiment described above, the description has been given with respect to the case where each of the thicknesses of the speaker diaphragm 2 and the speaker diaphragm 20 is set to 1 [mm], and each of the dimples 16 concerned is set to 0.5 [mm] as ½ of the thickness. However, the present invention is by no means limited thereto, and thus the speaker diaphragm 2 and the speaker diaphragm 20 each having any of various kinds of thicknesses may also be used.

In addition, in the embodiment described above, the description has been given with respect to the case where for the thickness of 1 [mm] of each of the speaker diaphragm 2 and the speaker diaphragm 20, each of the depths of the dimples 16 is set to 0.5 [mm] as ½ of the thickness. However, the present invention is by no means limited thereto, and thus each of the depths of the dimples 16 may also be determined at any of other various kinds of rates such as ⅓ and ⅔ of the thickness.

In addition, in the embodiment described above, the description has been given with respect to the case where the speaker diaphragm of the present invention is composed of the speaker diaphragm 2, 20 as the diaphragm, and the dimples 16 as the dimples. However, the present invention is by no means limited thereto, and thus the speaker diaphragm may also be composed of a diaphragm composed of any of other various kinds of structures, and dimples each composed of other various kinds of structures.

In addition, in the embodiment described above, the description has been given with respect to the case where the pitch of the plural dimples disposed on the most outer periphery side is set to about 3 [mm], and is formed so as to become gradually narrow toward the most inner peripheral side, that is, so as to become about 1 [mm], about 0.5 [mm], etc. However, the present invention is by no means limited thereto, and thus a pitch having any other suitable size may also be adopted as long as the pitch on the outer periphery side is large and is formed so as to become gradually narrow toward the most inner periphery side.

In addition, in the embodiment described above, the description has been given with respect to the case where the dimples 16 each formed so as to have the diameter of 6 [mm] are provided in the speaker diaphragm 2, 20. However, the present invention is by no means limited thereto, and thus dimples each formed so as to formed so as to have any of other various kinds of diameters may also be provided in the speaker diaphragm 2, 20 as long as the arch structure can be ensured with the size thereof.

In addition, in the embodiment described above, the description has been given with respect to the case where the speaker device of the present invention is composed of the speaker diaphragm 2, 20 as the diaphragm, the dimples 16 as the dimples, and the magnetic circuit portion 15 as the magnetic circuit portion. However, the present invention is by no means limited thereto, and thus the speaker device may also be composed of a diaphragm composed of any of other various kinds of structures, dimples each composed of any of other various kinds of structures, and a magnetic circuit portion composed of any of other various kinds of configurations.

INDUSTRIAL APPLICABILITY

The speaker device of the present invention can be applied as the in-car subwoofer based on an assumption that the in-car subwoofer is installed within the trunk or the like of the car, and in addition thereto can also be applied as the subwoofer for the domestic home theater or the like. In addition, the speaker diaphragm of the present invention can be used as the speaker diaphragm 2 of the in-car subwoofer, and in addition thereto can also be applied as a cone paper of a television or a personal computer, or the diaphragm for a headphone or a microphone.

EXPLANATION OF REFERENCE NUMERALS

1 . . . Speaker device, 2 . . . Speaker diaphragm, 3 . . . Edge, 4 . . . Frame, 5 . . . Voice coil, 6 . . . Voice coil bobbin, 7 . . . Mounting member, 8 . . . Damper, 9 . . . Plate, 10 . . . Magnet, 11 . . . Yoke, 12 . . . Magnetic circuit portion, 16 . . . Dimple

The invention claimed is:

1. A speaker diaphragm, comprising:

a diaphragm; and plural dimples which are radially disposed from a center side of said diaphragm toward an outer periphery side of said diaphragm so as to form a plurality of circle-like arrangements of dimples, and which have arch structures each formed so as to have a concave-like shape in such a way that a stress is dispersed, wherein any of said dimples are not formed at a central portion on the most inner periphery side of said diaphragm, and said central portion on the most inner periphery side is used as a spacer for a notation such as a brand name or a logo, wherein a pitch of adjacent dimples in a respective circle-like arrangement becomes smaller as a radial position of a circle-like arrangement goes from the outer periphery side towards the center side of said diaphragm, such that for each of the circle-like arrangements the respective pitch of adjacent dimples in one circle-like arrangement is the same as or less than that of an immediately adjacent circle-like arrangement as the circle-like arrangements go from the outer periphery side towards the center side of said diaphragm, and wherein the pitch of adjacent dimples has a value of approximately 3 mm for each dimple in the respective circle-like arrangement of the outer periphery side and has a value of approximately 0.5 mm for each dimple of the respective circle-like arrangement of the center side.

2. The speaker diaphragm according to claim 1, wherein said dimples have the arch structures in which radii of curvature of said dimples are all equal to each other in order to disperse a stress when said diaphragm is vibrated.

3. The speaker diaphragm according to claim 2, wherein said dimples are formed in a state in which a thickness of said diaphragm is grinded down.

4. The speaker diaphragm according to claim 3, wherein said dimples are each formed to a depth which is ½ of the thickness of said diaphragm.

5. The speaker diaphragm according to claim 4, wherein said dimples are formed in such a way that diameters thereof become smaller as the position is located from the outer periphery side toward the center side of said diaphragm.

6. The speaker diaphragm according to claim 5, wherein said diaphragm entirely has a cone-like shape, and an outer periphery portion has a pentagon.

7. A speaker device, comprising:

a diaphragm;

plural dimples which are radially disposed from a center side of said diaphragm toward an outer periphery side of said diaphragm so as to form a plurality of circle-like arrangements of dimples, and which have arch structures each formed so as to have a concave-like shape in such a way that a stress is dispersed; and a magnetic circuit portion for vibrating said diaphragm in accordance with an audio signal, wherein any of said dimples are not formed at a central portion on the most inner periphery side of said diaphragm, and said central portion on the most inner periphery side is used as a spacer for a notation such as a brand name or a logo, and wherein a pitch of adjacent dimples in a respective circle-like arrangement becomes smaller as a radial position of a circle-like arrangement goes from the outer periphery side towards the center side of said diaphragm, such that for each of the circle-like arrangements the respective pitch of adjacent dimples in one circle-like arrangement is the same as or less than that of an immediately adjacent circle-like arrangement as the circle-like arrangements go from the outer periphery side towards the center side of said diaphragm, and wherein the pitch of adjacent dimples has a value of approximately 3 mm for each dimple in the respective circle-like arrangement of the outer periphery side and has a value of approximately 0.5 mm for each dimple of the respective circle-like arrangement of the center side.

* * * * *